US008581500B2

(12) United States Patent
Kim et al.

(10) Patent No.: US 8,581,500 B2
(45) Date of Patent: Nov. 12, 2013

(54) SYSTEM FOR MANUFACTURING POWER SUPPLY UNIT AND METHOD FOR MANUFACTURING POWER SUPPLY UNIT, AND FLICKER MEASUREMENT APPARATUS

(75) Inventors: Jin Sung Kim, Seoul (KR); Kyu Cheol Kang, Suwon-si (KR); Jin Woo Bae, Seoul (KR); Choul Ho Lee, Suwon-si (KR); Jong Yang Choo, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 165 days.

(21) Appl. No.: 13/315,935

(22) Filed: Dec. 9, 2011

(65) Prior Publication Data

US 2012/0146516 A1 Jun. 14, 2012

(30) Foreign Application Priority Data

Dec. 10, 2010 (KR) ..... 10-2010-0126560
Sep. 30, 2011 (KR) ..... 10-2011-0100146
Nov. 30, 2011 (KR) ..... 10-2011-0126575

(51) Int. Cl.
*H05B 37/02* (2006.01)

(52) U.S. Cl.
USPC ..... 315/134; 315/291; 315/151

(58) Field of Classification Search
None
See application file for complete search history.

(56) References Cited

U.S. PATENT DOCUMENTS 7,906,917 B2 * 3/2011 Tripathi et al. ..... 315/291

FOREIGN PATENT DOCUMENTS

| | | | |
|---|---|---|---|
| JP | 2005-109535 | A | 4/2005 |
| JP | 4221309 | B2 | 11/2008 |
| KR | 10-0981972 | B1 | 9/2010 |

* cited by examiner

*Primary Examiner* — Crystal L Hammond
(74) *Attorney, Agent, or Firm* — McDermott Will & Emery LLP

(57) ABSTRACT

A method of manufacturing a power supply unit (PSU) is provided. The method includes providing at least one PSU supplying a dimming signal to at least one light source, performing a first test for electrical characteristics of the at least one PSU, detecting light emitted from the at least one light source, measuring a flicker of the at least one light source, and performing a second test for a state of the at least one PSU based on a flicker measurement result, and packing a PSU determined to be in a normal state among the at least one PSU, as a result of the first test and the second test.

20 Claims, 16 Drawing Sheets

300

SYSTEM FOR MANUFACTURING POWER SUPPLY UNIT AND METHOD FOR MANUFACTURING POWER SUPPLY UNIT, AND FLICKER MEASUREMENT APPARATUS

CROSS-REFERENCE TO RELATED APPLICATIONS

This application claims the benefit of Korean Patent Application Nos. 10-2010-0126560, of Korean Patent Application No. 10-2011-0100146, and of Korean Patent Application No. 10-2011-0126575, respectively filed on Dec. 10, 2010, Sep. 30, 2011, and Nov. 30, 2011, in the Korean Intellectual Property Office, the disclosures of which are incorporated herein by reference.

BACKGROUND

1. Field of the Invention

The present invention relates to a system and method for manufacturing a power supply unit (PSU), and a flicker measurement apparatus.

2. Description of the Related Art

A light-emitting diode (LED) refers to a light source to convert electric energy to light energy. Recently, the LED is being applied to a lighting field, as well as, is being used as a display device, due to advantages of the LED, for example a rapid processing speed, low power consumption, a long durability, and the like.

The LED is operated by receiving a power source supplied from a power supply unit (PSU). For example, when the PSU is abnormally operated, the LED may also be abnormally operated, and a flicker phenomenon may occur. In the flicker phenomenon, light emitted from the LED may flicker. The flicker phenomenon occurring in the LED may be affected by a state of the PSU that supplies the power source to the LED. Accordingly, in manufacturing of the PSU, a test to determine the state of the PSU may be performed.

Conventionally, to determine a state of a PSU, a user visually checks light emitted from an LED connected to the PSU. In other words, when the flicker phenomenon is visually observed, the user determines the PSU to be in an abnormal state. However, there is a difference in measuring the flicker phenomenon due to an individual variation of the user (for example, age, sight, fatigue, and the like). Accordingly, there is a desire for a technology that may exactly measure the flicker phenomenon of the LED, and may accurately determine a quality state of the PSU.

SUMMARY

An aspect of the present invention provides a system and method for manufacturing a power supply unit (PSU) that may determine electrical characteristics and a state of each of at least one PSU through tests, and may pack a PSU determined to be in a normal state among the at least one PSU.

Another aspect of the present invention provides a flicker measurement apparatus that may measure a flicker of at least one light-emitting diode (LED), and may determine a state of at least one PSU.

Still another aspect of the present invention provides a flicker measurement apparatus that may store and manage result data obtained by determining a state of at least one PSU, and may facilitate use of the result data.

Yet another aspect of the present invention provides a lighting apparatus employing a PSU determined to be in the normal state by a flicker measurement apparatus.

According to an aspect of the present invention, there is provided a method of manufacturing a PSU, including: providing at least one PSU supplying a dimming signal to at least one light source; performing a first test for electrical characteristics of the at least one PSU; detecting light emitted from the at least one light source, measuring a flicker of the at least one light source, and performing a second test for a state of the at least one PSU based on a flicker measurement result; and packing a PSU determined to be in a normal state among the at least one PSU, as a result of the first test and the second test.

According to another aspect of the present invention, there is provided a system for manufacturing a PSU, including: a PSU manufacturing equipment to provide at least one PSU supplying a dimming signal to at least one light source; a first test equipment to perform a first test for electrical characteristics of the at least one PSU; a second test equipment to detect light emitted from the at least one light source, to measure a flicker of the at least one light source, and to perform a second test for a state of the at least one PSU based on a flicker measurement result; and a packing equipment to pack a PSU determined to be in a normal state among the at least one PSU by the first test equipment and the second test equipment.

According to still another aspect of the present invention, there is provided a flicker measurement apparatus, including: a light detecting module to detect a light emitted from at least one light source; a signal input/output module to input and output a signal, the signal input/output module being connected to at least one PSU supplying a dimming signal to the at least one light source; a signal processing module to convert the detected light into an electrical signal, and to process the electrical signal; and a control module to control the at least one PSU based on a dimming control signal, to measure a flicker of the at least one light source using the processed electrical signal, and to determine a state of the at least one PSU based on a flicker measurement result obtained by measuring the flicker.

According to yet another aspect of the present invention, there is provided a lighting apparatus including: a light source for lighting; and a PSU to supply a power source to the light source, the PSU being determined to be in a normal state by a flicker measurement apparatus.

According to a further aspect of the present invention, there is provided a method of manufacturing a PSU, including: controlling at least one PSU based on a dimming control signal, the at least one PSU supplying a dimming signal to at least one light source; detecting a light emitted from the at least one light source; converting the detected light into an electrical signal, and processing the electrical signal; measuring a flicker of the at least one light source using the processed electrical signal; and determining a state of the at least one PSU based on a flicker measurement result obtained by measuring the flicker.

According to a further aspect of the present invention, there is provided a control module, including: an input unit to receive an input of information required to generate a dimming control signal, the dimming control signal being used to control an operation of at least one PSU; a signal transmitter to transmit the dimming control signal to the at least one PSU; a signal receiver to receive a frequency signal corresponding to a light detected from at least one light source; a first controller to generate the dimming control signal based on the received information; and a second controller to measure a flicker of the at least one light source using the received frequency signal, and to test the at least one PSU based on a flicker measurement result obtained by measuring the flicker.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
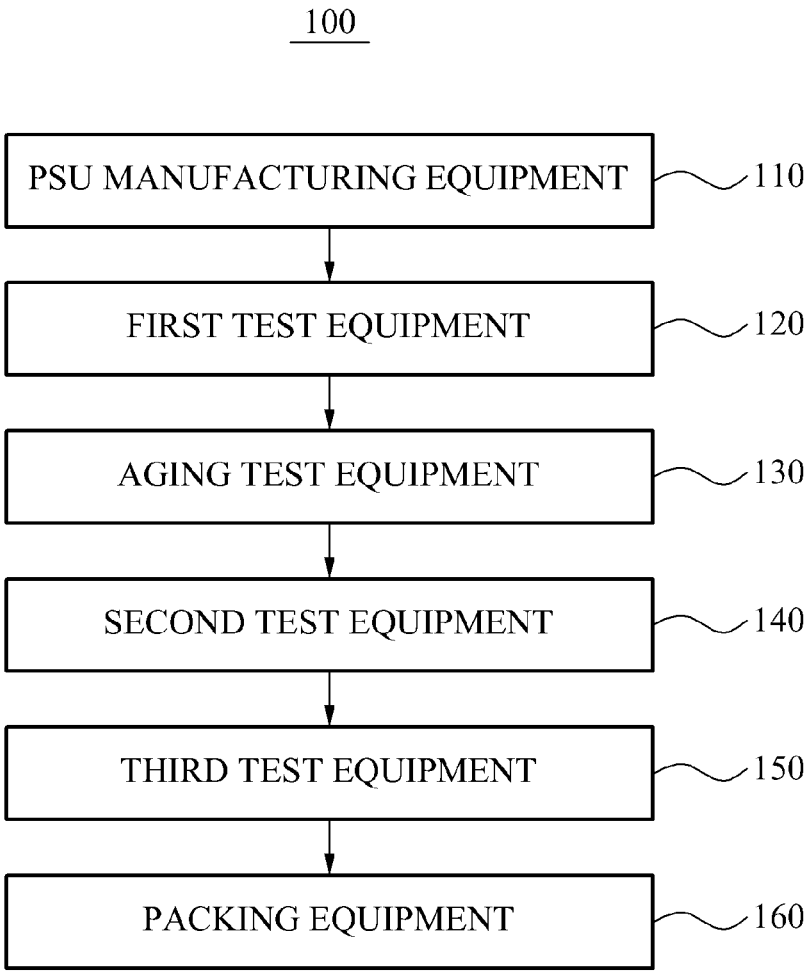
FIG. 1 is a block diagram illustrating a system for manufacturing a power supply unit (PSU) according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures. FIG. 1 is a block diagram illustrating a system 100 for manufacturing a power supply unit (PSU) according to an embodiment of the present invention.

Referring to FIG. 1, the system 100 may include a PSU manufacturing equipment 110, a first test equipment 120, an aging test equipment 130, a second test equipment 140, a third test equipment 150, and a packing equipment 160.

The PSU manufacturing equipment 110 may provide at least one PSU. The at least one PSU may supply a dimming signal to at least one light source, and may enable the at least one light source to emit light. For example, when a PSU is abnormally operated, a light source that receives a diming signal supplied from the PSU may also be abnormally operated. Accordingly, when a PSU is manufactured by the PSU manufacturing equipment 110, a test to determine whether the PSU is normally operated may be performed.

The first test equipment 120 may perform a first test for electrical characteristics of the at least one PSU provided by the PSU manufacturing equipment 110.

The aging test equipment 130 may test the at least one PSU in a severe environment. The aging test equipment 130 may generate an aging signal including an aging condition and aging time that are set or inputted in advance, and may perform an aging test on the PSU in the aging condition during the aging time, based on the aging signal.

The second test equipment 140 may detect light emitted from at least one light source, may measure a flicker of the at least one light source, and may perform a second test for a state of the at least one PSU based on a flicker measurement result obtained by measuring the flicker.

The aging test equipment 130 is separated from the second test equipment 140, as shown in FIG. 1, however, may be included in the second test equipment 140. In other words, the second test equipment 140 may be configured to perform the second test, namely to measure the flicker, after performing the aging test.

Prior to packing a PSU determined to be in a normal state by the first test equipment 120 and the second test equipment 140, the third test equipment 150 may perform a third test for at least one of consumed power of the PSU, an output current of the PSU, an output voltage of the PSU, a withstanding voltage of the PSU, and whether the PSU is normally operated. During the first test, the aging test, and the second test, stress may be applied to a PSU due to each test environment. Since the stress may have an influence on the electrical characteristics of the PSU, the third test may be again performed to test the electrical characteristics of the PSU when the first test, the aging test, and the second test are completed. The third test equipment 150 may not be necessarily required, and may be selectively included in the system 100, when necessary.

The packing equipment 160 may pack a PSU that is determined to be in the normal state by the first test equipment 120, the second test equipment 140, and the third test equipment 150, among the at least one PSU. Specifically, the packing equipment 160 may pack the PSU with a static dissipative vinyl, and may store the packed PSU in a preset unit, in a packing box including a silica gel. For example, the packing equipment 160 may store four PSUs in a single packing box with two stages so that each of the two stages may store two PSUs. During a packing process, the packing equipment 160 may determine a number of PSUs in the packing box, whether a silica gel used to remove moisture from the packing box is included in the packing box, whether the static dissipative vinyl is used for packing, whether an error occurs in a pearlite core, and the like.

Figure 2:
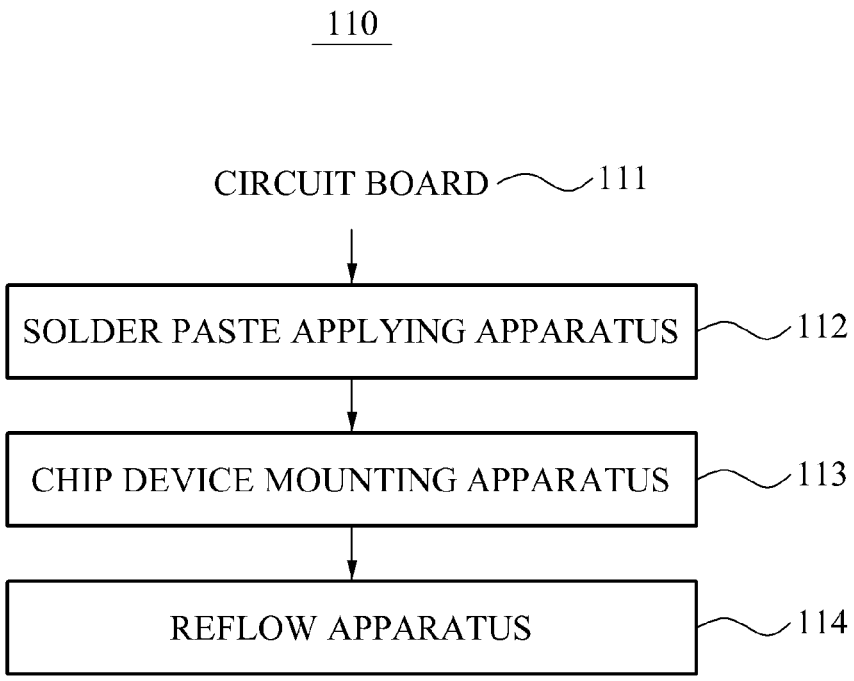
FIG. 2 is a block diagram illustrating a configuration of a PSU manufacturing equipment in the system of FIG. 1.

FIG. 2 is a block diagram illustrating a configuration of the PSU manufacturing equipment 110 of FIG. 1.

Referring to FIG. 2, the PSU manufacturing equipment 110 may include a solder paste applying apparatus 112, a chip device mounting apparatus 113, and a reflow apparatus 114.

The solder paste applying apparatus 112 may apply a solder past on a circuit board 111 that is included in a PSU. Specifically, the solder paste applying apparatus 112 may apply the solder paste by printing the solder paste, when a solder mask (not shown) is placed on the circuit board 111.

The chip device mounting apparatus 113 may mount at least one chip device on the circuit board 111 using the solder paste. In this instance, the chip device may be, for example, a passive device such as a resistor-capacitor (RC) circuit device, a diode device, and the like, that are required to enable the circuit board 111 to function as a PSU.

The reflow apparatus 114 may enable the solder paste to reflow at a predetermined temperature, and may connect the chip device to the circuit board 111.

In general, a PSU may be manufactured by mounting a chip device on a surface of the circuit board 111, but there is no limitation thereto. Accordingly, a PSU may be manufactured by mounting chip devices on another surface of the circuit board 111, as well as the surface, when necessary. In this instance, to mount the chip device on the other surface of the circuit board 111, the PSU manufacturing equipment 110 may further include another solder paste applying apparatus, another chip device mounting apparatus, and another reflow apparatus.

Figure 3:
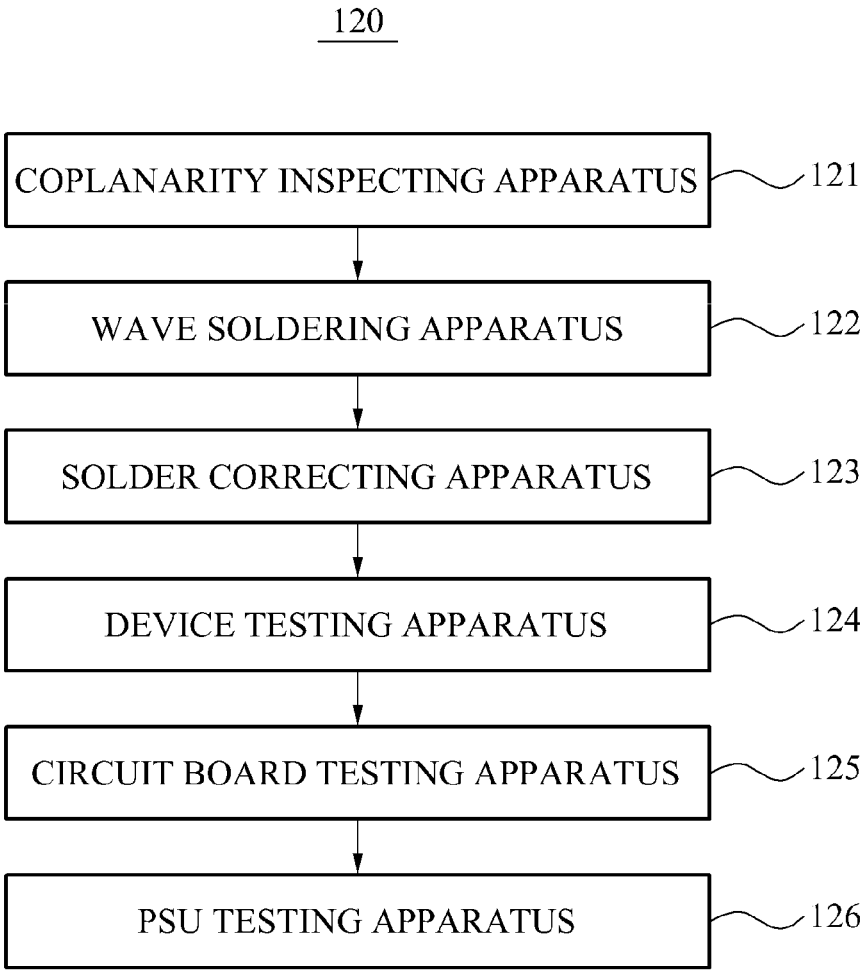
FIG. 3 is a block diagram illustrating a configuration of a first test equipment in the system of FIG. 1.

FIG. 3 is a block diagram illustrating a configuration of the first test equipment 120 of FIG. 1.

Referring to FIG. 3, the first test equipment 120 may include a coplanarity inspecting apparatus 121, a wave soldering apparatus 122, a solder correcting apparatus 123, a device testing apparatus 124, a circuit board testing apparatus 125, and a PSU testing apparatus 126.

The coplanarity inspecting apparatus 121 may inspect coplanarity of components of each of at least one PSU. Specifically, the coplanarity inspecting apparatus 121 may irradiate light to the at least one PSU, may receive a reflected light, and may inspect the coplanarity of the components, in particular, coplanarity of the solder paste. Here, laser light, X-ray, and the like may be irradiated to the at least one PSU.

The wave soldering apparatus 122 may re-solder the solder paste, based on whether components are lifted. For example, when the coplanarity inspecting apparatus 121 determines that components of a PSU are lifted, a solder paste applied to the PSU may be re-soldered.

The solder correcting apparatus 123 may re-touch the components attached to the re-soldered solder paste, and may eliminate a component lifting phenomenon.

The device testing apparatus 124 may test electrical characteristics of at least one chip device mounted on the circuit board 111.

The circuit board testing apparatus 125 may test electrical characteristics of the circuit board 111.

The PSU testing apparatus 126 may test at least one PSU for at least one of consumed power, an output current, an output voltage, a withstanding voltage, and whether the at least one PSU is normally operated.

Figure 4:
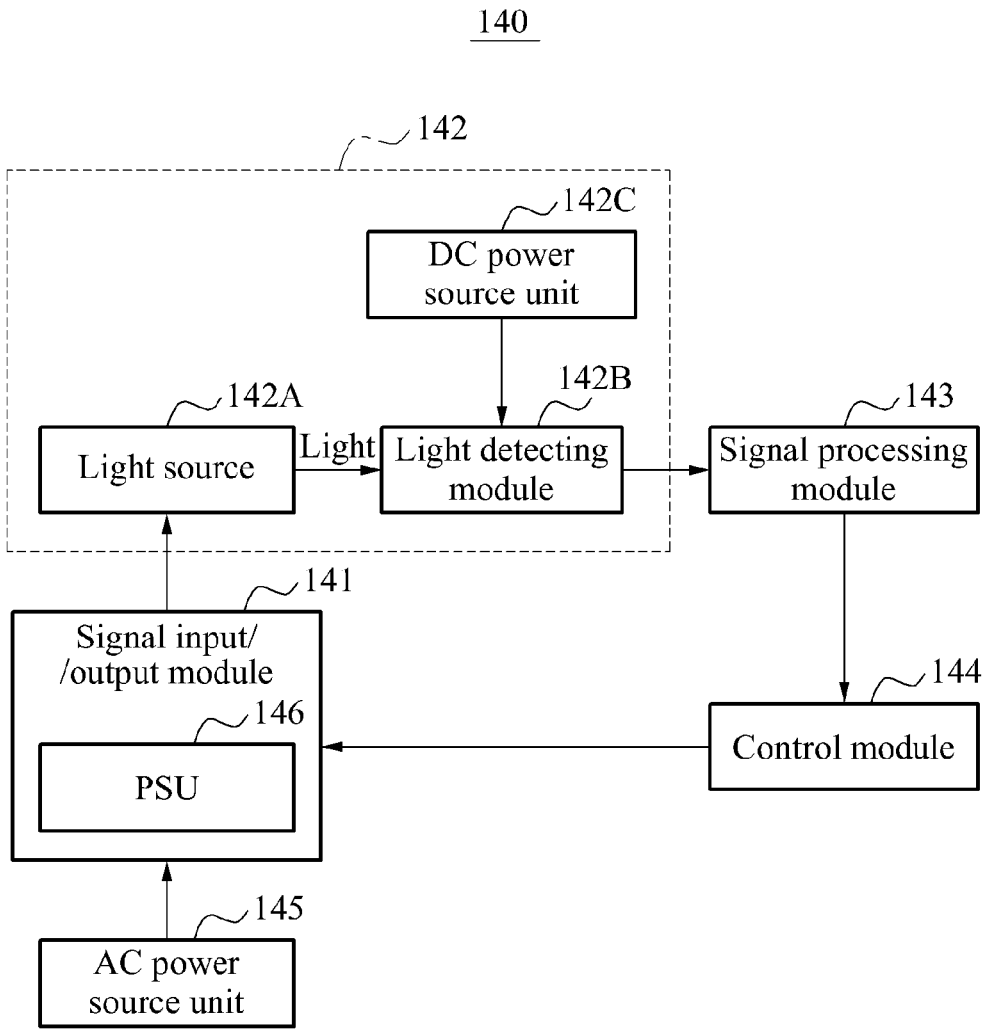
FIG. 4 is a block diagram illustrating a configuration of a second test equipment in the system of FIG. 1.

FIG. 4 is a block diagram illustrating a configuration of the second test equipment 140 of FIG. 1. The second test equipment 140 of FIG. 4 may be used as a flicker measurement apparatus, to measure a flicker of a light source operated in response to a dimming signal supplied from a PSU, and to determine a state of the PSU. In the present specification, the second test equipment 140 may be referred to as a flicker measurement apparatus 140.

Referring to FIG. 4, the flicker measurement apparatus 140 may include a signal input/output module 141, a light source 142A, a light detecting module 142B, a signal processing module 143, a control module 144, an alternating current (AC) power source unit 145, and a direct current (DC) power source unit 142C.

The signal input/output module 141 may be electrically connected to a PSU 146 used to measure a flicker. Additionally, the signal input/output module 141 may receive signals from an external apparatus or from other elements included in the flicker measurement apparatus 140, or may output a signal of the PSU 146. To receive or output signals, the signal input/output module 141 may include a contact terminal, and a signal input/output terminal that are used for electrical connection to the PSU 146.

Additionally, the signal input/output module 141 may be included in a tray (not shown) that provides space in which the PSU 146 is to be mounted. Specifically, when the contact terminal, and the signal input/output terminal are placed inside and outside the space, and when the PSU 146 is mounted in the space, the tray may enable the contact terminal to be connected to the PSU 146. Accordingly, the signal input/output module 141 may transfer a signal to the PSU 146 via the signal input/output terminal, or may output a signal from the PSU 146 to the external apparatus.

The tray may have a structure that enables a plurality of PSUs to be simultaneously mounted, or a structure that enables a single PSU to be mounted. When the tray has a structure that enables a single PSU to be mounted, the flicker measurement apparatus 140 may include a plurality of trays.

The PSU 146, mounted in the tray, may receive various signals including a dimming control signal through the signal input/output module 141, and may output a dimming signal.

The PSU 146 may be operated by receiving an AC power source supplied from the AC power source unit 145 through the signal input/output module 141.

The PSU 146 may supply a dimming signal to the light source 142A. The dimming signal may enable the light source 142A to emit light. Specifically, when the dimming control signal is received from the control module 144 via the signal input/output module 141, the PSU 146 may supply the dimming signal to the light source 142A based on the dimming control signal.

The light source 142A, the light detecting module 142B, and the DC power source unit 142C may be installed within a housing 142.

When the dimming signal is received from the PSU 146, the light source 142A may emit light. The light source 142A enabling emitting of light may include, for example, a light-emitting diode (LED), a fluorescent lamp, a lamp, and the like.

The light detecting module 142B may be operated by receiving a DC power source supplied from the DC power source unit 142C. The light detecting module 142B may be placed above the light source 142A, to detect light emitted from the light source 142A and detect intensity of the emitted light.

The signal processing module 143 may convert the light detected by the light detecting module 142B into an electrical signal, and may process the electrical signal. In other words, the signal processing module 143 may process the detected light to be a signal that may be processed by the control module 144.

The control module 144 may generate a dimming control signal, and may control the PSU 146 based on the generated dimming control signal.

Additionally, the control module 144 may measure a flicker of the light source 142A using the electrical signal processed by the signal processing module 143. The control module 144 may test the PSU 146 based on a flicker measurement result obtained by measuring the flicker of the light source 142A.

A flicker phenomenon occurring in the light source 142A may be affected by a state of the PSU 146, and accordingly the control module 144 may measure the flicker of the light source 142A, and may determine the state of the PSU 146. To accurately determine the state of the PSU 146, a standard light source that is normally operated may be used as the light source 142A.

The control module 144 may determine whether the PSU 146 is in a normal state, or an abnormal state, based on the flicker measurement result, and may store and manage result data obtained by determining the state of the PSU 146. A user may verify the state of the PSU 146 based on the result data, and may sort out defective products prior to shipping products.

Figure 5:
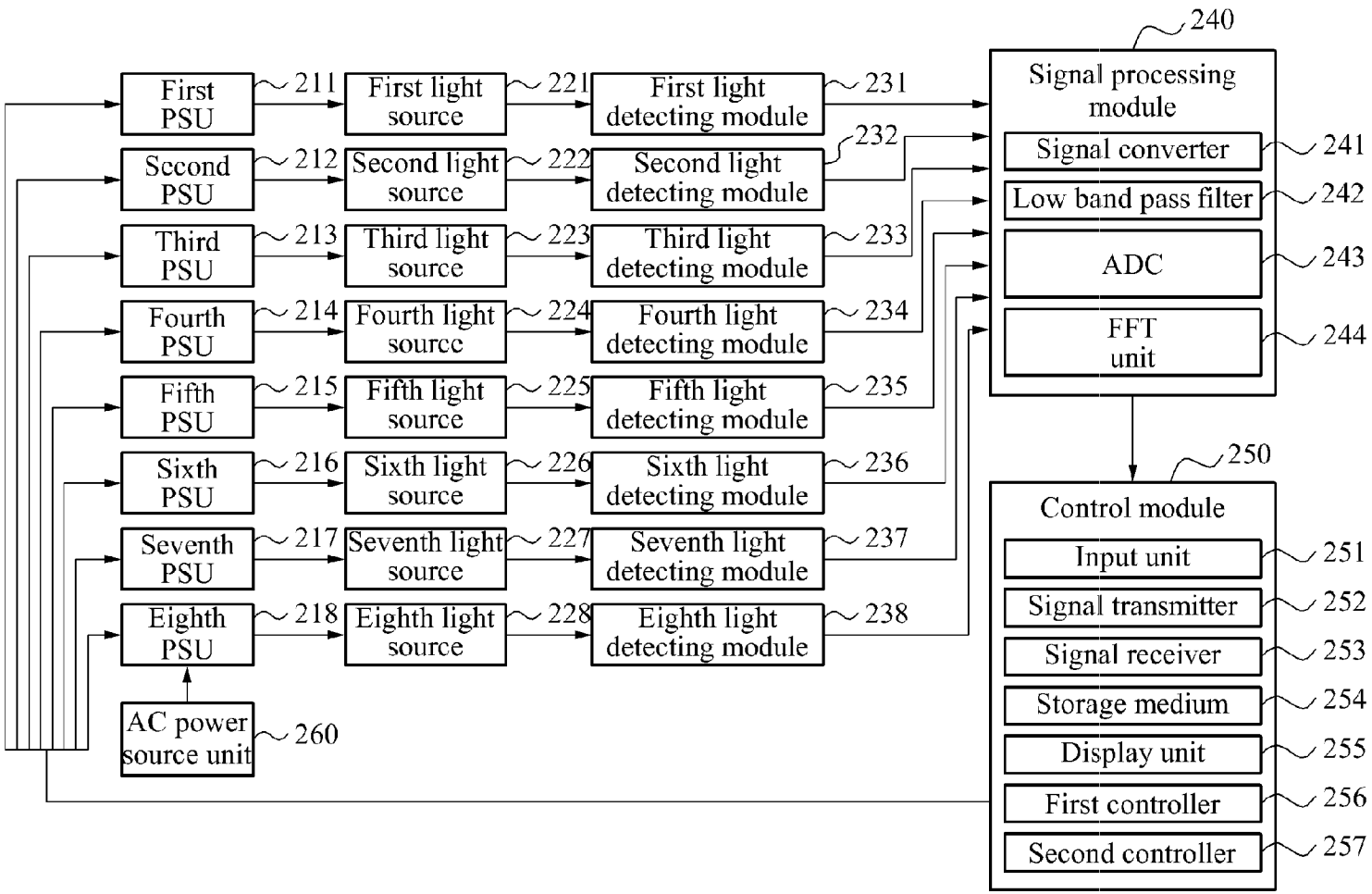
FIG. 5 is a block diagram illustrating another configuration of the second test equipment according to another embodiment of the present invention.

FIG. 5 is a block diagram illustrating a configuration of a flicker measurement apparatus 200 according to another embodiment of the present invention. Hereinafter, the configuration and operation of the flicker measurement apparatus 140 of FIG. 4 will be further described with reference to FIG. 5.

Referring to FIG. 5, the flicker measurement apparatus 200 may include a first PSU 211, a second PSU 212, a third PSU 213, a fourth PSU 214, a fifth PSU 215, a sixth PSU 216, a seventh PSU 217, an eighth PSU 218, a first light source 221, a second light source 222, a third light source 223, a fourth light source 224, a fifth light source 225, a sixth light source 226, a seventh light source 227, an eighth light source 228, a first light detecting module 231, a second light detecting module 232, a third light detecting module 233, a fourth light detecting module 234, a fifth light detecting module 235, a sixth light detecting module 236, a seventh light detecting module 237, an eighth light detecting module 238, a signal processing module 240, a control module 250, and an AC power source unit 260.

The AC power source unit 260 may supply a power source to drive the first PSU 211 to the eighth PSU 218.

Although not shown in FIG. 5, the first PSU 211 to the eighth PSU 218 may receive the power source from the AC power source unit 260, via signal input/output modules that are connected to the first PSU 211 to the eighth PSU 218, respectively.

The first PSU 211 to the eighth PSU 218 may be connected to the first light source 221 to the eighth light source 228, respectively, to individually supply dimming signals to the first light source 221 to the eighth light source 228. The dimming signal may be used to adjust intensity of illumination, or brightness of the first light source 221 to the eighth light source 228. The dimming signal may be one of a DC voltage signal, a pulse width modulation (PWM) signal, and a triode alternating current (TRIAC) signal.

The first light source 221 to the eighth light source 228 may emit light, in response to the dimming signals supplied from the first PSU 211 to the eighth PSU 218.

The first light detecting module 231 to the eighth light detecting module 238 may be placed on the first light source 221 to the eighth light source 228, to detect light emitted from the first light source 221 to the eighth light source 228, respectively. Specifically, the first light detecting module 231 to the eighth light detecting module 238 may detect the light emitted from the first light source 221 to the eighth light source 228, and may detect intensity of the light. For example, photodiodes may be used as the first light detecting module 231 to the eighth light detecting module 238.

A DC power source unit, although not shown in FIG. 5, may be connected to each of the first light detecting module 231 to the eighth light detecting module 238, and may supply a DC power source to the first light detecting module 231 to the eighth light detecting module 238.

The signal processing module 240 may receive the detected light from the first light detecting module 231 to the eighth light detecting module 238, may convert the received light into electrical signals, and may process the electrical signals.

The signal processing module 240 may include a signal converter 241, a low band pass filter 242, an analog-to-digital converter (ADC) 243, and a fast Fourier transform (FFT) unit 244.

The signal converter 241 may convert the light detected by the first light detecting module 231 to the eighth light detecting module 238 into an electrical signal. The electrical signal may be a frequency waveform signal corresponding to the intensity of the light.

The low band pass filter 242 may perform filtering on a high-frequency signal included in the electrical signal, and may enable a low-frequency signal to pass, in order to remove noise from the electrical signal.

The ADC 243 may convert the low-frequency signal into a digital signal.

The FFT unit 244 may perform FFT on the digital signal output from the ADC 243, and may generate a frequency signal. Here, the frequency signal may include an AC component and a DC component.

The control module 250 may include an input unit 251, a signal transmitter 252, a signal receiver 253, a storage medium 254, a display unit 255, a first controller 256, and a second controller 257.

The input unit 251 may receive input of information required to generate an aging signal and information required to generate a dimming control signal, and may receive an input of a data read command.

The signal transmitter 252 may transmit a predetermined signal to the first PSU 211 to the eighth PSU 218.

The signal receiver 253 may receive the frequency signal from the signal processing module 240.

The storage medium 254 may store an information input screen, an information output screen, and a variety of data.

The display unit 255 may display the information input screen, the information output screen, and the variety of data.

When an information input screen for generation of an aging signal is displayed on the display unit 255, and when an aging condition and an aging time are inputted through the input unit 251, the first controller 256 may generate an aging signal including the inputted aging condition and the inputted aging time.

The first controller 256 may control an aging operation of the first PSU 211 to the eighth PSU 218, based on the generated aging signal. Specifically, the first controller 256 may control the signal transmitter 252 to transmit the aging signal to the first PSU 211 to the eighth PSU 218.

The first PSU 211 to the eighth PSU 218 may receive the aging signal, and may perform the aging operation in the aging condition during the aging time. For example, when "40° C.," and "10 minutes" are set as the aging condition and the aging time, the first PSU 211 to the eighth PSU 218 may perform the aging operation while maintaining a temperature of 40° C. for 10 minutes. Accordingly, the first PSU 211 to the eighth PSU 218 may each include a light-emitting configuration, and a temperature sensor. Additionally, the aging condition may include a high voltage, or vibration, in addition to a temperature.

When an information input screen for generation of a dimming control signal is displayed on the display unit 255, and when pieces of information are inputted through the input unit 251, the first controller 256 may generate a dimming control signal including the pieces of information.

The dimming control signal may be generated individually for each of the first PSU 211 to the eighth PSU 218, and may include channel information associated with the first PSU 211 to the eighth PSU 218. Additionally, the dimming control signal may include a dimming signal range in which a dimming signal is to be supplied to each of the first PSU 211 to the eighth PSU 218, a dimming signal interval to be adjusted within the dimming signal range, and a period in which a dimming signal is to be supplied and that corresponds to the dimming signal interval.

The first controller 256 may control the first PSU 211 to the eighth PSU 218, based on the generated dimming control signal.

The first PSU 211 to the eighth PSU 218 may receive dimming control signals, may adjust dimming signal intervals within dimming signal ranges during periods, and may supply dimming signals to the first light source 221 to the eighth light source 228, respectively.

For example, when a dimming signal range, a dimming signal interval, and a period for first channel information of the first PSU 211 are set to a range of 0.1 V to 10 V, to 0.5 V, and to 15 seconds, respectively, the first PSU 211 may adjust the dimming signal interval to increase by 0.5 V for every 15 seconds in the range of 0.1 V to 10 V, and may supply a DC voltage signal to the first light source 211. The first light source 211 may perform a dimming operation to change a luminance every 15 seconds, in response to the DC voltage signal.

The second controller 257 may measure a flicker for each of the first light source 221 to the eighth light source 228, and may determine states of the first PSU 211 to the eighth PSU 218, based on flicker measurement results.

When the frequency signal is received by the signal receiver 253, the second controller 257 may separate the AC component and the DC component from the frequency signal, may compute a ratio of the AC component to the DC component, and may measure the flicker for each of the first light source 221 to the eighth light source 228.

The frequency signal may include identification information associated with the first light source 221 to the eighth light source 228. The second controller 257 may verify the identification information in the frequency signal, may classify the frequency signal for each of the first light source 221 to the eighth light source 228, and may divide the classified frequency signal into the AC component and the DC component.

Additionally, the second controller 257 may compute the ratio of the AC component to the DC component, and may measure the flicker for each of the first light source 221 to the eighth light source 228. The ratio may be computed using Equation 1 or 2 below. In other words, a flicker of each of the first light source 221 to the eighth light source 228 may be measured using the following Equation 1 or 2:

$$\text{Flicker Ratio (\%)} = \frac{ACrms}{DC} \times 100 \qquad \text{[Equation 1]}$$

$$\text{Flicker Ratio (dB)} = 10\log\left(\frac{ACrms}{DC}\right) \qquad \text{[Equation 2]}$$

In Equations 1 and 2, ACrms denotes a peak value of an AC component, and DC denotes a DC component. A flicker ratio computed by the Equations 1 and 2 may be represented by '%' or 'dB.'

When a flicker measured using Equation 1 or 2 is less than a predetermined threshold, the second controller 257 may determine that the first PSU 211 to the eighth PSU 218 to be in the normal state.

When the measured flicker is equal to or greater than the predetermined threshold, the second controller 257 may determine that the first PSU 211 to the eighth PSU 218 to be in the abnormal state.

The second controller 257 may measure a flicker using a single set of a single PSU, a single light source, and a single light detecting module, and may determine a state of a corresponding PSU based on a flicker measurement result. For example, a set of the first PSU 211, the first light source 221, and the first light detecting module 231 of FIG. 5 may be used to measure a flicker of the first light source 221.

When the states of the first PSU 211 to the eighth PSU 218 are determined, the second controller 257 may generate result data by matching dimming control signals transmitted to the first PSU 211 to the eighth PSU 218, frequency signals corresponding to light detected by the first light detecting module 231 to the eighth light detecting module 238, a flicker measurement result for the first light source 221 to the eighth light source 228, and the determined states of the first PSU 211 to the eighth PSU 218.

The second controller 257 may classify result data based on a data generation time, a specification of a PSU, a specification of a light source, and the like, and may store the classified result data in the storage medium 254.

Additionally, when a command to read result data is received from the input unit 251, the second controller 257 may read result data corresponding to the command from the storage medium 254, and may display the read result data on the display unit 255.

The control module 250 may be included, as a single element, in a data processing apparatus, such as a computer, or may be implemented as a separate module.

As described above, the flicker measurement apparatus 200 of FIG. 5 may supply dimming signals to the first light source 221 to the eighth light source, so that a flicker may be automatically measured based on a predetermined threshold. Accordingly, it is possible to accurately determine the states of the first PSU 211 to the eighth PSU 218, based on a flicker measurement result.

Additionally, the determined states of the first PSU 211 to the eighth PSU 218 may be stored and managed in readable forms, and thus it is easier to use the result data.

Figure 6:
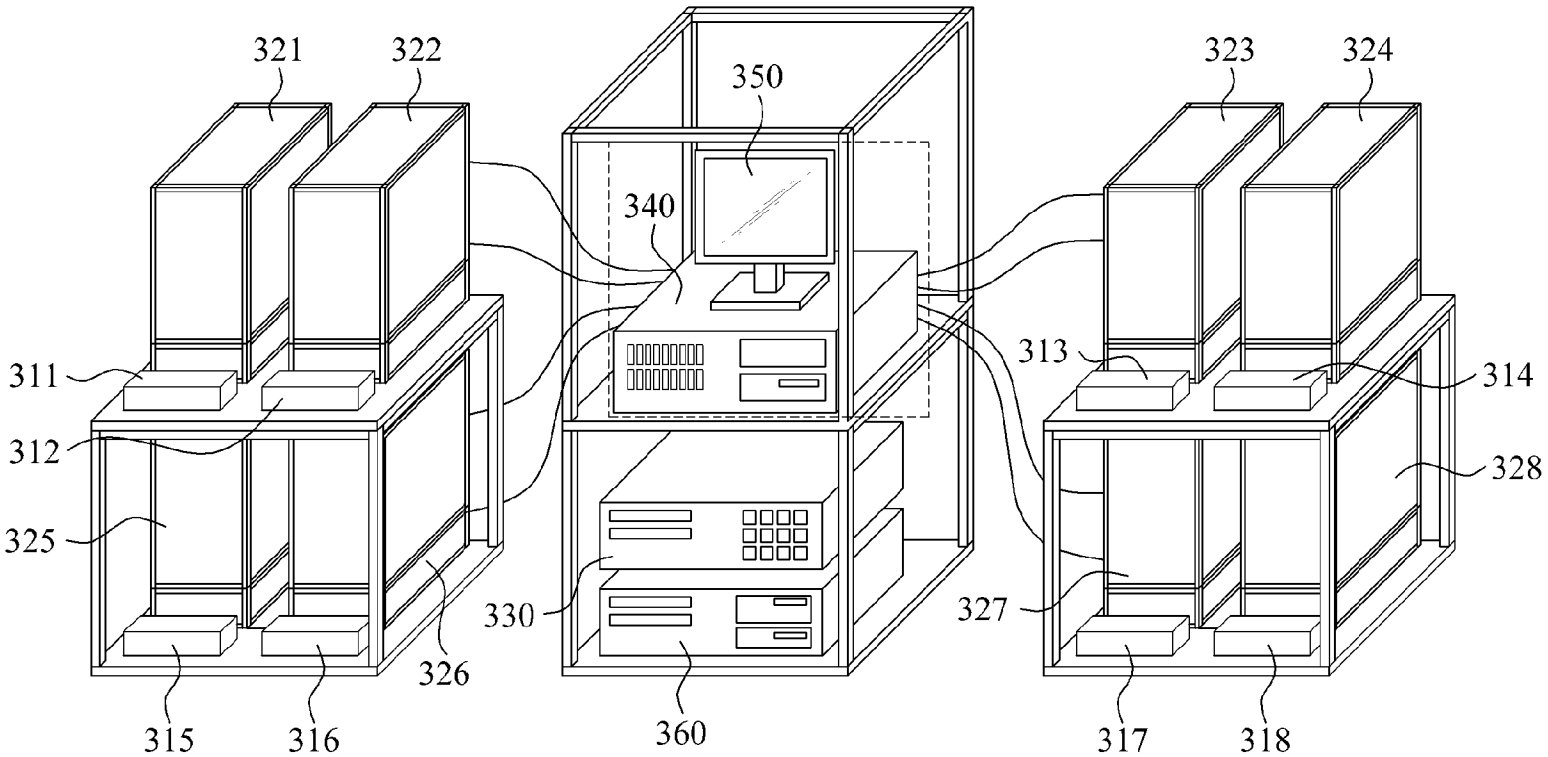
FIG. 6 is a diagram illustrating a structure of an exterior of a flicker measurement apparatus according to an embodiment of the present invention.

FIG. 6 is a diagram illustrating a structure of an exterior of a flicker measurement apparatus 300 according to another embodiment of the present invention.

The flicker measurement apparatus 300 of FIG. 6 may include a first PSU 311, a second PSU 312, a third PSU 313, a fourth PSU 314, a fifth PSU 315, a sixth PSU 316, a seventh PSU 317, an eighth PSU 318, a first housing 321, a second housing 322, a third housing 323, a fourth housing 324, a fifth housing 325, a sixth housing 326, a seventh housing 327, an eighth housing 328, a signal processing module 330, a control module 340, a display apparatus 350, and an AC power source unit 360.

Each of the first housing 321 to the eighth housing 328 may include at least one light source, and a light detecting module. The at least one light source may be loaded in each of the first housing 321 to the eighth housing 328, and may be used to measure a flicker. The light detecting module may be used to detect light emitted from the at least one light source.

The first housing 321 to the eighth housing 328 may have the same structure. Hereinafter, a structure of the first housing 321 will be described with reference to FIG. 7.

Figure 7:
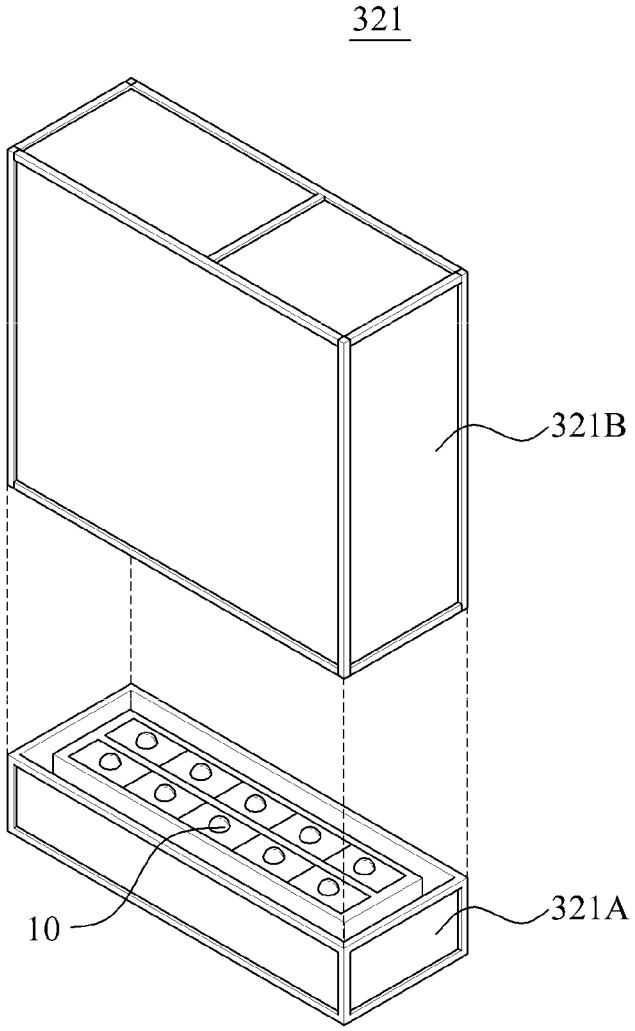
FIG. 7 is a diagram illustrating a structure of a first housing of FIG. 6.

FIG. 7 is a diagram illustrating the structure of the first housing 321 of FIG. 6. As shown in FIG. 7, the first housing 321 may include a loading box 321A, and a housing cover 321B.

The loading box 321A may include space in which a light source 10 is loaded, and a signal line (not shown) used to transfer a dimming signal supplied from an external source to the light source 10.

The light source 10 may be loaded in the loading box 321A as an individual device, or in one of a package form and a module form. A model or type of a light source loaded in a loading box of each of the first housing 321 to the eighth housing 328 may be identical to, or different from each other.

When the light source 10 is loaded in the loading box 321A, the signal line may be placed to be physically connected to an electrode included in the light source 10.

The housing cover 321B may be mounted above the loading box 321A, or may be detached from the loading box 321A. Although not shown in FIG. 7, a light detecting module with an adjustable height may be included in the housing cover 321B. Specifically, the light detecting module may be placed on a side wall of the housing cover 321B, and a distance between the light detecting module and the light source 10 loaded in the loading box 321A may be adjusted by adjusting the height of the light detecting module.

A light detecting performance of the light detecting module may vary depending on the distance between the light detecting module and the light source 10. For example, when the distance is short, high luminance may be measured, compared to a long distance between the light detecting module and the light source 10. Accordingly, to prevent luminance from being incorrectly measured, the distance between the light detecting module and the light source 10 may be adjusted by adjusting the height of the light detecting module based on a shape, a size, and the like of the light source 10 loaded in the loading box 321A.

The light detecting module may include a photodiode used to receive light emitted from the light source 10. The photodiode may be operated by a voltage of about 30 V.

When the housing cover 321B is mounted above the loading box 321A, inner space of the first housing 321 may be darkened, so that light may be blocked. Accordingly, light detecting module may detect only the light emitted from the light source 10, by preventing the emitted light from leaking outside the first housing 321, and simultaneously preventing light from entering the first housing 321.

The first PSU 311 to the eighth PSU 318 may be disposed in front of the first housing 321 to the eighth housing 328, may be connected to light sources loaded in the first housing 321 to the eighth housing 328, and may supply dimming signals to the first housing 321 to the eighth housing 328, respectively.

The signal processing module 330 may be located in the center, and may be connected to light detecting modules loaded in the first housing 321 to the eighth housing 328, and may receive light detected by the light detecting modules. Additionally, the signal processing module 330 may convert the received light into an electrical signal, may process the electrical signal to generate a frequency signal, and may transmit the frequency signal to the control module 340. The frequency signal may include an AC component, and a DC component.

The control module 340 may be located above the signal processing module 330. The control module 340 may generate a dimming control signal, may measure a flicker for each of light sources loaded in the first housing 321 to the eighth housing 328, and may determine states of the first PSU 311 to the eighth PSU 318 based on a flicker measurement result.

Additionally, the control module 340 may store and manage, in a storage medium (not shown), result data obtained by determining the states of the first PSU 311 to the eighth PSU 318, may read the result data in response to a read command, and may display the read result data on the display apparatus 350.

The first PSU 311 to the eighth PSU 318, and the first housing 321 to the eighth housing 328 of FIG. 6 have been described. However a number of PSUs and a number of housings may not be limited, and accordingly may be changed depending on embodiments.

Figure 8:
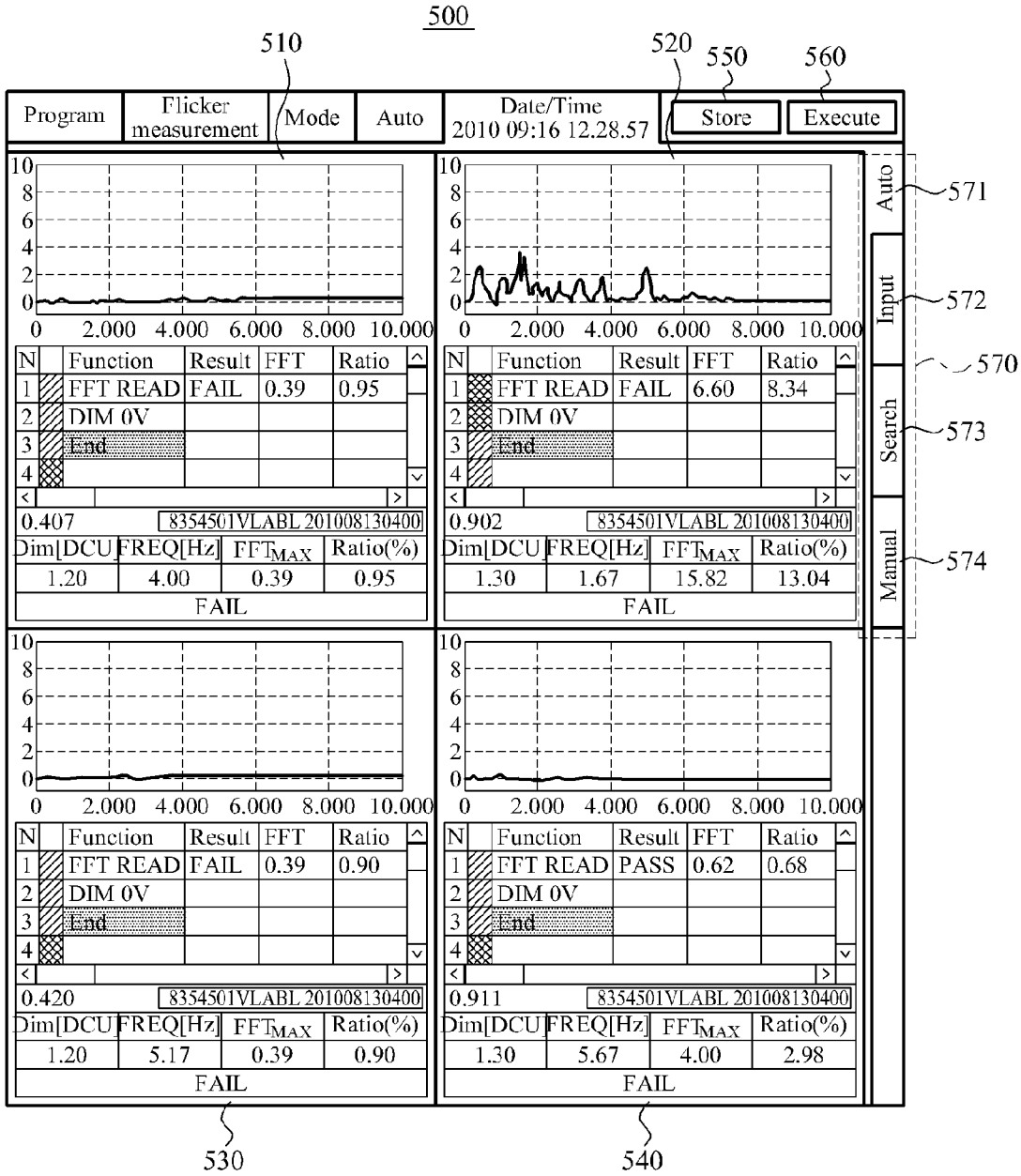
FIG. 8 is a diagram illustrating an information input screen used to generate a dimming control signal according to an embodiment of the present invention.

FIG. 8 is a diagram illustrating an information input screen 500 used to generate a dimming control signal according to an embodiment of the present invention. The information input screen 500 of FIG. 8 (hereinafter, referred to as an 'input screen 500') may be provided by the control module 144 of FIG. 4, the control module 250 of FIG. 5, or the control module 340 of FIG. 6.

The input screen 500 may include a first subscreen 510, a second subscreen 520, a third subscreen 530, a fourth subscreen 540, a storage button 550, an execution button 560, and information-related button 570.

The first subscreen 510 to the fourth subscreen 540 may display an input screen, and a flicker measurement state for light sources. The input screen may enable input of information used to generate a dimming control signal. For example, the first subscreen 510 to the fourth subscreen 540 may correspond to the first PSU 311 to the fourth PSU 314, and light sources loaded in the first housing 321 to the fourth housing 324 of FIG. 6, respectively.

The information-related button 570 may include an automatic button 571, an input button 572, a search button 573, and a manual button 574. The automatic button 571 and the input button 572 may be used to input information required to generate dimming control signals to control the first PSU 311 to the fourth PSU 314.

For example, when a user selects the automatic button 571, the input screen 500 may input information used to generate a dimming control signal. Additionally, when the user selects the input button 572, the input screen 500 may display a separate information input window. For example, the input screen 500 may display, in the form of a popup, an information input window including a plurality of input spaces enabling input of an aging condition, an aging time, a dimming signal range, a dimming signal interval, a time period, and the like.

When pieces of information used to generate dimming control signals are inputted using the automatic button 571 or the input button 572, and when the user selects the storage button 550, the control modules 144, 250, or 340 may store the pieces of information in a storage medium.

When pieces of information used to generate dimming control signals are inputted using the automatic button 571 or the input button 572, and when the user selects the execution button 560, the control modules 144, 250, or 340 may generate dimming control signals, and may transmit the generated dimming control signals to the first PSU 311 to the fourth PSU 314.

When the first PSU 311 to the fourth PSU 314 supply dimming signals to the light sources in the first housing 321 to the fourth housing 324, respectively, based on the dimming control signals, the control modules 144, 250, or 340 may receive a frequency signal corresponding to light emitted from each of the light sources, and may measure a flicker. A process of measuring a flicker may be displayed on the first subscreen 510 to the fourth subscreen 540. Accordingly, the user may verify a flicker measurement state while monitoring the first subscreen 510 to the fourth subscreen 540.

The search button 573 may be used to search for flicker measurement result data, and result data obtained by determining states of the first PSU 311 to the fourth PSU 314 based on a flicker measurement result. Additionally, the manual button 574 may be used to verify various settings, and a method of using the input screen 500.

Four subscreens, namely the first subscreen 510 to the fourth subscreen 540, are illustrated in FIG. 8, but there is no limitation thereto. Accordingly, a number of subscreens displayed on a single screen may vary depending on a number of PSUs and a number of housings that are included in a flicker measurement apparatus.

Figure 9:
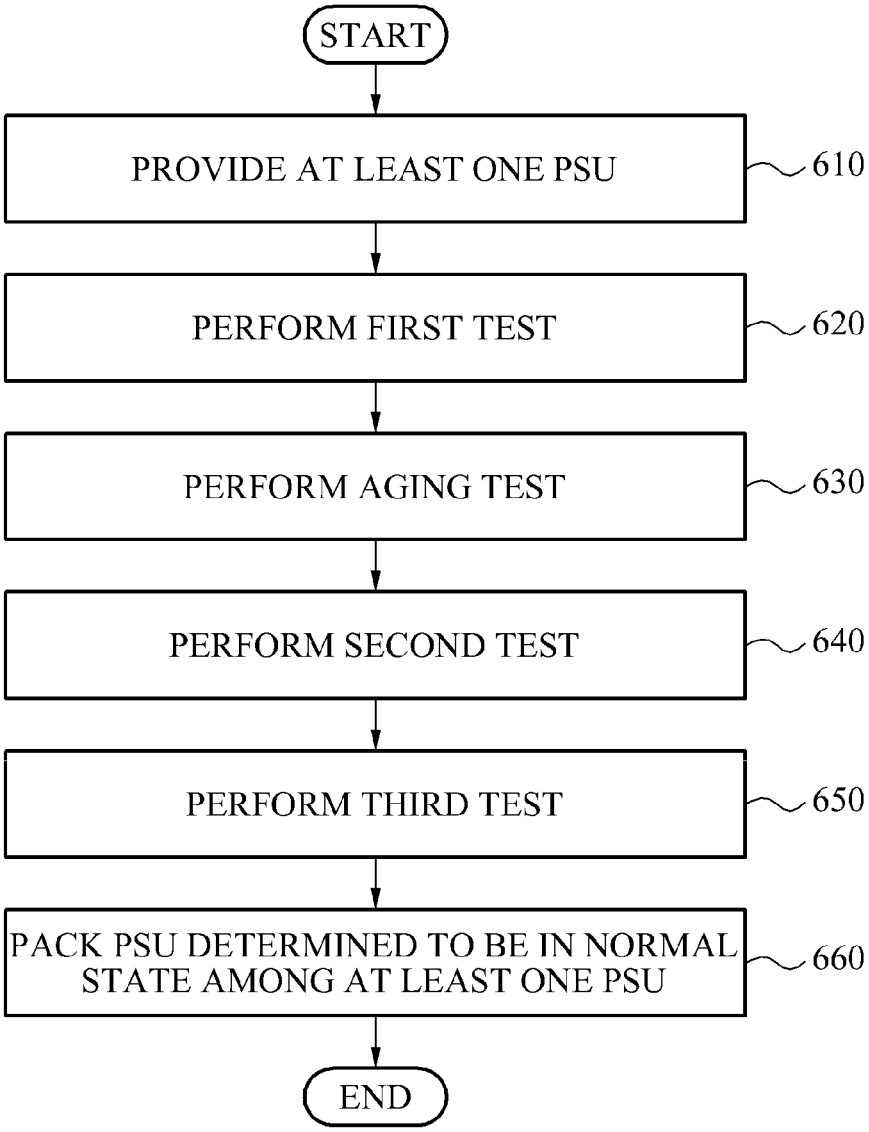
FIG. 9 is a flowchart illustrating a method of manufacturing a PSU according to an embodiment of the present invention.

FIG. 9 is a flowchart illustrating a method of manufacturing a PSU according to an embodiment of the present invention. The method of FIG. 9 may be performed by the system 100 of FIG. 1.

Referring to FIG. 9, in operation 610, the system 100 may provide at least one PSU used to supply a dimming signal to at least one light source.

In operation 620, the system 100 may perform a first test for electrical characteristics of the at least one PSU.

In operation 630, the system 100 may perform an aging test on the at least one PSU, in an aging condition during an aging time, based on an aging signal. Here, the aging signal may include the aging condition, and the aging time.

In operation 640, the system 100 may detect light emitted from the at least one light source, may measure a flicker of the at least one light source, and may perform a second test for a state of the at least one PSU based on a flicker measurement result.

After the second test, the system 100 may perform a third test for at least one of consumed power of a PSU, an output current of the PSU, an output voltage of the PSU, a withstanding voltage of the PSU, and whether the PSU is normally operated in operation 650.

In operation 660, the system 100 may pack a PSU determined to be in the normal state as a result of the first test, the second test, and the third test, among the at least one PSU.

Figure 10:
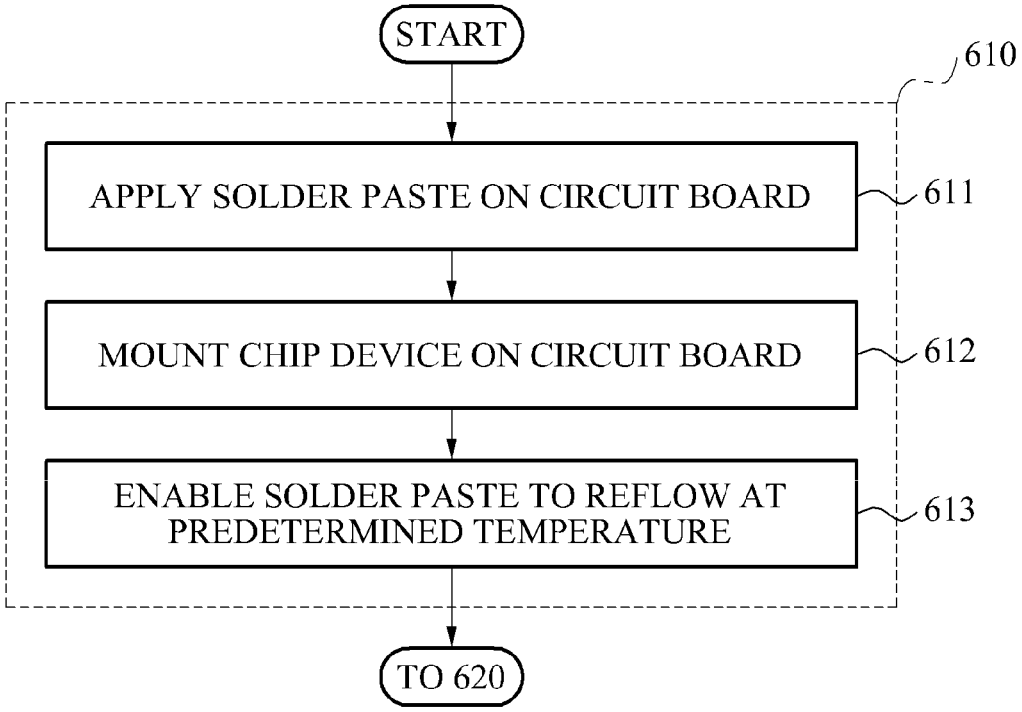
FIG. 10 is a flowchart further illustrating an operation of providing at least one PSU in the method of FIG. 9.

FIG. 10 is a flowchart further illustrating operation 610 of FIG. 9. Operations 611 through 613 of FIG. 10 may be performed by the PSU manufacturing equipment 110 shown in FIG. 2.

Referring to FIG. 10, in operation 611, the PSU manufacturing equipment 110 may apply a solder paste on the circuit board 111.

In operation 612, the PSU manufacturing equipment 110 may mount at least one chip device on the circuit board 111 using the solder paste.

In operation 613, the PSU manufacturing equipment 110 may enable the solder paste to reflow at a predetermined temperature.

Operations 611 through 613 may be performed to manufacture a PSU by attaching a chip device on a surface of the circuit board 111 (for example, an upper surface). For example, when a chip device is attached on another surface of the circuit board 111 (for example, a lower surface), operations 611 through 613 may be performed on the other surface.

Figure 11:
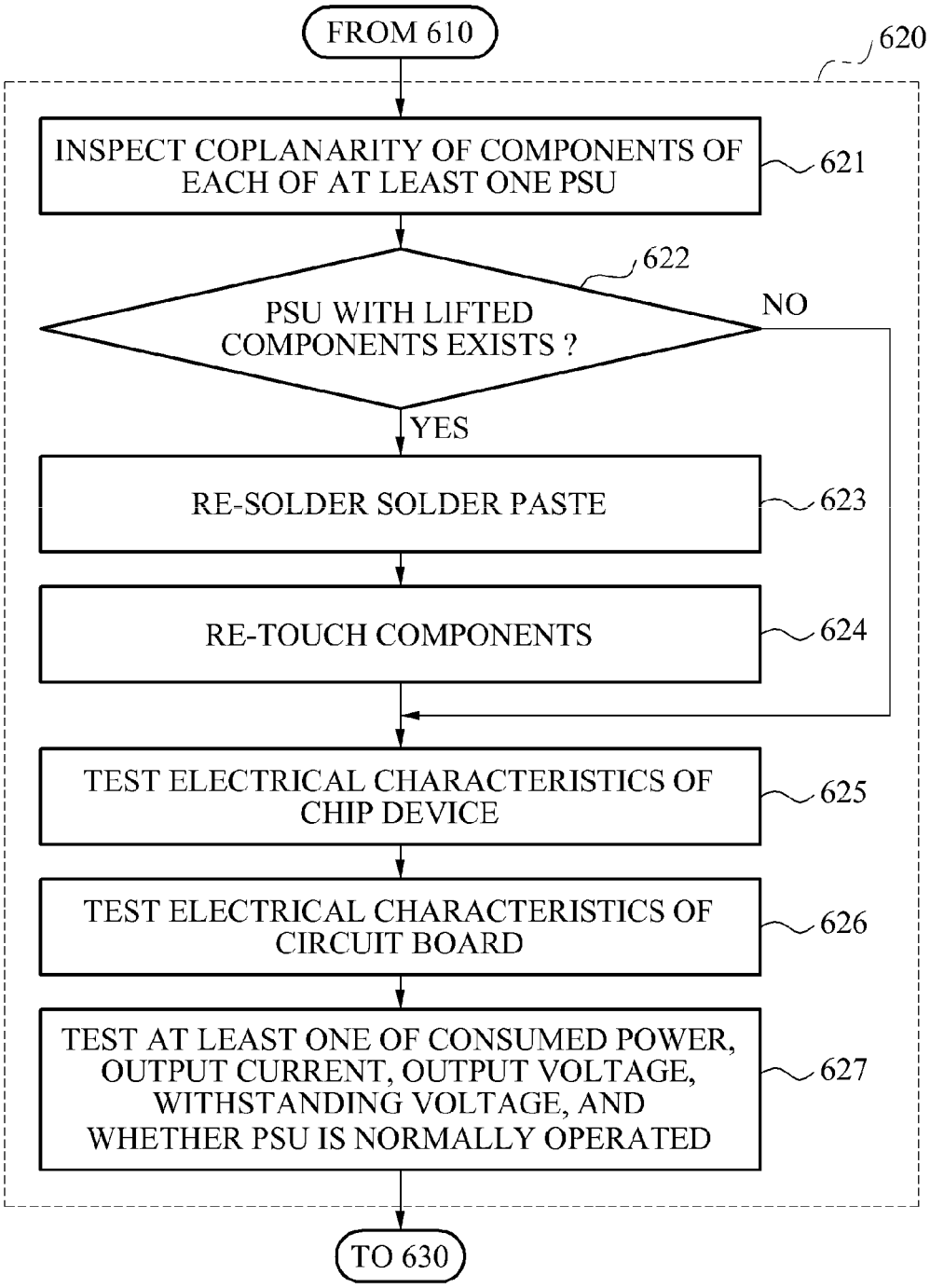
FIG. 11 is a flowchart further illustrating an operation of performing a first test in the method of FIG. 9.

FIG. 11 is a flowchart further illustrating operation 620 of FIG. 9. Operations 621 through 627 of FIG. 11 may be performed by the first test equipment 120 shown in FIG. 3.

Referring to FIG. 11, in operation 621, the first test equipment 120 may inspect coplanarity of components of each of the at least one PSU.

When a PSU with lifted components exists in operation 622, the first test equipment 120 may re-solder a solder paste applied to the PSU in operation 623. In operation 624, the first test equipment 120 may re-touch components attached to the re-soldered solder paste, and may eliminate a component lifting phenomenon.

When a PSU with lifted components does not exist in operation 622, or when the component lifting phenomenon is eliminated through operations 623 and 624, the first test equipment 120 may test electrical characteristics of at least one chip device mounted on the circuit board 111 in operation 625. In other words, whether the chip device is normally operated may be tested.

In operation 626, the first test equipment 120 may test electrical characteristics of the circuit board 111. In other words, whether the circuit board 111 is normally operated may be tested.

In operation 627, the first test equipment 120 may test at least one of consumed power of the PSU, an output current of the PSU, an output voltage of the PSU, a withstanding voltage of the PSU, and whether the PSU is normally operated.

The first test equipment 120 may individually test the chip device, or the circuit board 111, by testing the electrical characteristics of each of the chip device and the circuit board 111. Additionally, the first test equipment 120 may test mutual electrical characteristics between the chip device and the circuit board 111, by testing electrical characteristics of the PSU.

Figure 12:
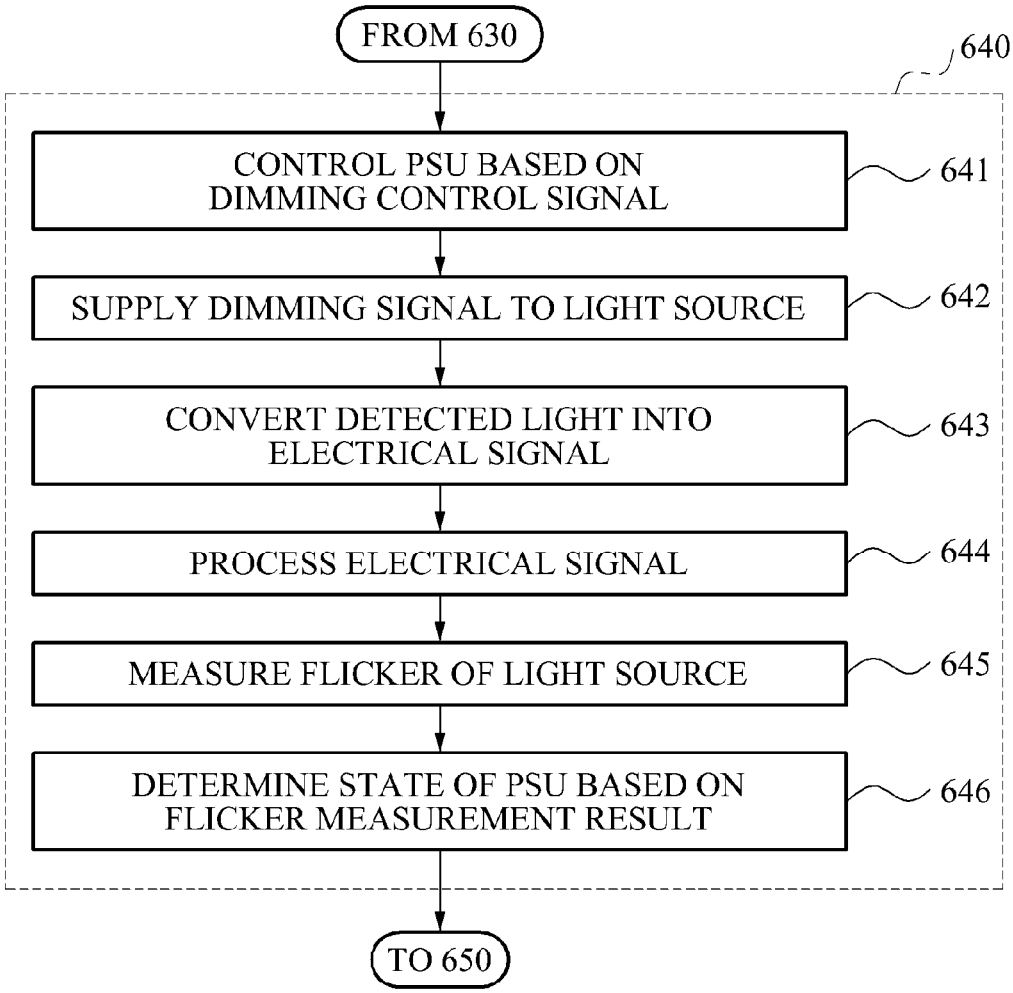
FIG. 12 is a flowchart further illustrating an operation of performing a second test in the method of FIG. 9.

FIG. 12 is a flowchart further illustrating operation 640 of FIG. 9. The second test of operation 640 may be performed to determine a state of a PSU by measuring a flicker of a light source operated by receiving a dimming signal supplied from the PSU. In the present specification, operations 641 through 646 of FIG. 12 may be performed to manufacture a PSU.

Operations 641 through 646 of FIG. 12 may be performed by the flicker measurement apparatus 140 shown in FIG. 4.

Referring to FIG. 12, in operation 641, the flicker measurement apparatus 140 may control the PSU 146 based on the dimming control signal. The dimming control signal may include channel information associated with the PSU 146, a dimming signal range in which the dimming signal is to be supplied to the light source 142A, a dimming signal interval to be adjusted within the dimming signal range, and a period in which the dimming signal is to be supplied and which corresponds to the dimming signal interval.

In operation 642, the flicker measurement apparatus 140 may supply a dimming signal to the light source 142A. Specifically, the PSU 146 in the flicker measurement apparatus 140 may supply the dimming signal to the light source 142A. Here, the dimming signal may be one of a DC voltage signal, a PWM signal, and a TRIAC signal.

In operation 643, the flicker measurement apparatus 140 may detect light from the light source 142A, and may convert the detected light into an electrical signal. In operation 644, the flicker measurement apparatus 140 may process the electrical signal.

In operation 645, the flicker measurement apparatus 140 may measure a flicker of the light source 142A using the processed electrical signal. In operation 646, the flicker measurement apparatus 140 may determine the state of the PSU 146 based on the flicker measurement result.

As described above, flicker measurement may be performed using a commercialized PSU, a state of the PSU may be determined based on a flicker measurement result, and a PSU determined to be in the normal state may be provided. However, the method of manufacturing a PSU is not limited thereto, and may further include designing a circuit of the PSU, and assembling the PSU. Additionally, the PSU manufacturing method may further include packing the PSU determined to be in the normal state, after the measuring of the flicker.

Figure 13:
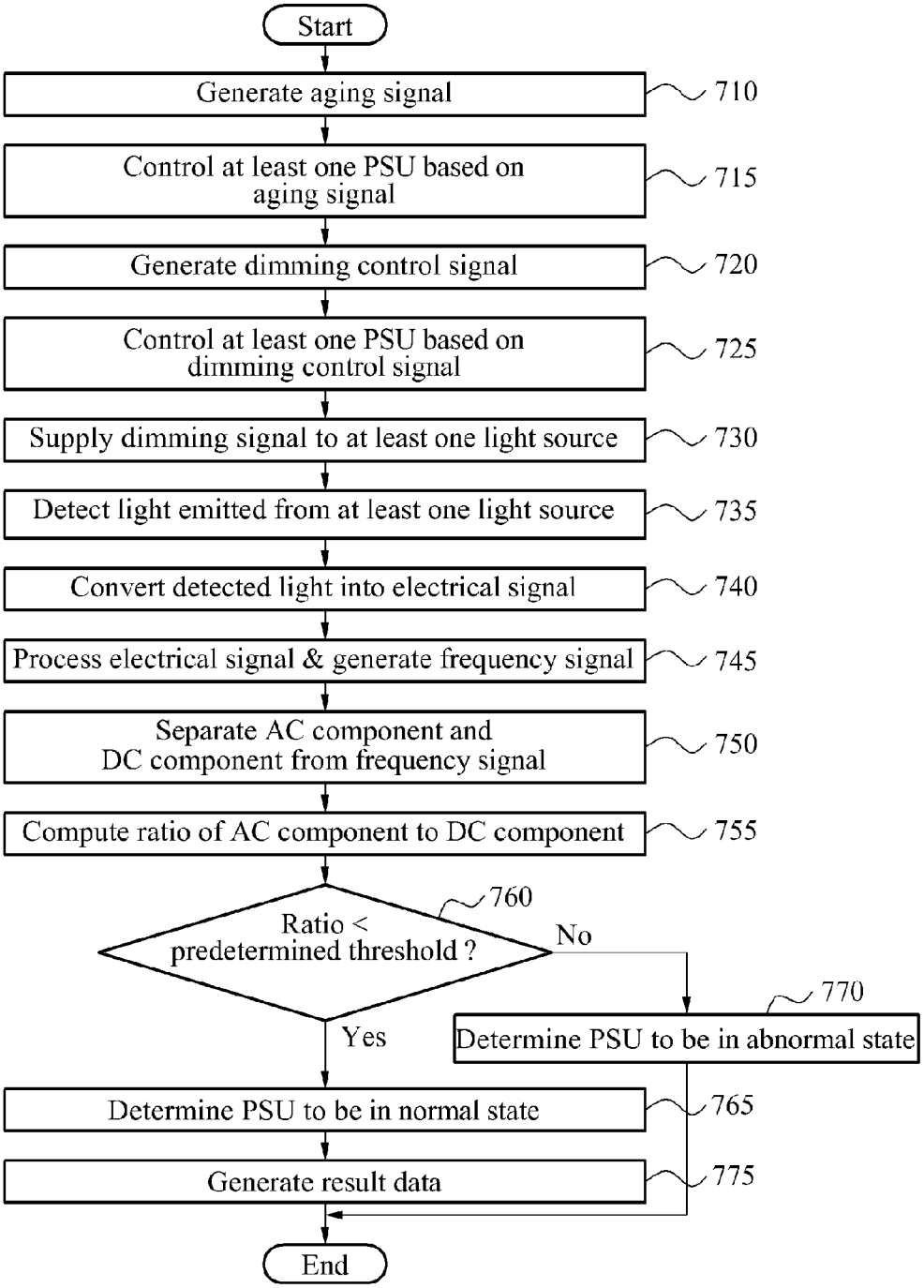
FIG. 13 is a flowchart illustrating an operation of performing a second test according to another embodiment of the present invention.

FIG. 13 a flowchart illustrating a method of manufacturing a PSU by performing a second test, namely, measuring a flicker according to another embodiment of the present invention. The method of FIG. 13 may be performed by the flicker measurement apparatus 200 of FIG. 5, or the flicker measurement apparatus 300 of FIG. 6.

In operation 710, the flicker measurement apparatus 200 or 300 may generate an aging signal. When information, such as an aging condition, or an aging time is inputted, the flicker measurement apparatus 200 or 300 may generate an aging signal including the aging condition and the aging time.

In operation 715, the flicker measurement apparatus 200 or 300 may control at least one PSU based on the aging signal. Specifically, the at least one PSU may perform an aging operation in the aging condition during the aging time, based on the aging signal. When the at least one PSU receives the same aging signal, the aging operation may be performed in the same condition during the same time.

In operation 720, the flicker measurement apparatus 200 or 300 may generate a dimming control signal. In operation 725, the flicker measurement apparatus 200 or 300 may control the at least one PSU based on the dimming control signal.

In operation 730, the flicker measurement apparatus 200 or 300 may supply a dimming signal to at least one light source. The at least one light source may emit light in response to the dimming signal.

In operation 735, the flicker measurement apparatus 200 or 300 may detect light emitted from the at least one light source.

In operation 740, the flicker measurement apparatus 200 or 300 may convert the detected light into an electrical signal. In operation 745, the flicker measurement apparatus 200 or 300 may process the electrical signal, and may generate a frequency signal. Here, the frequency signal may include an AC component and a DC component.

In operation 750, the flicker measurement apparatus 200 or 300 may separate the AC component and the DC component from the frequency signal.

In operation 755, the flicker measurement apparatus 200 or 300 may compute a ratio of the AC component to the DC component. When the computed ratio is less than a predetermined threshold in operation 760, the flicker measurement apparatus 200 or 300 may determine a corresponding PSU to be in the normal state in operation 765. Conversely, when the computed ratio is equal to or greater than the predetermined threshold in operation 760, the flicker measurement apparatus 200 or 300 may determine a corresponding PSU to be in the abnormal state in operation 770.

In operation 775, the flicker measurement apparatus 200 or 300 may generate result data regarding the state of the PSU determined in operation 765 or 770.

Figure 14:
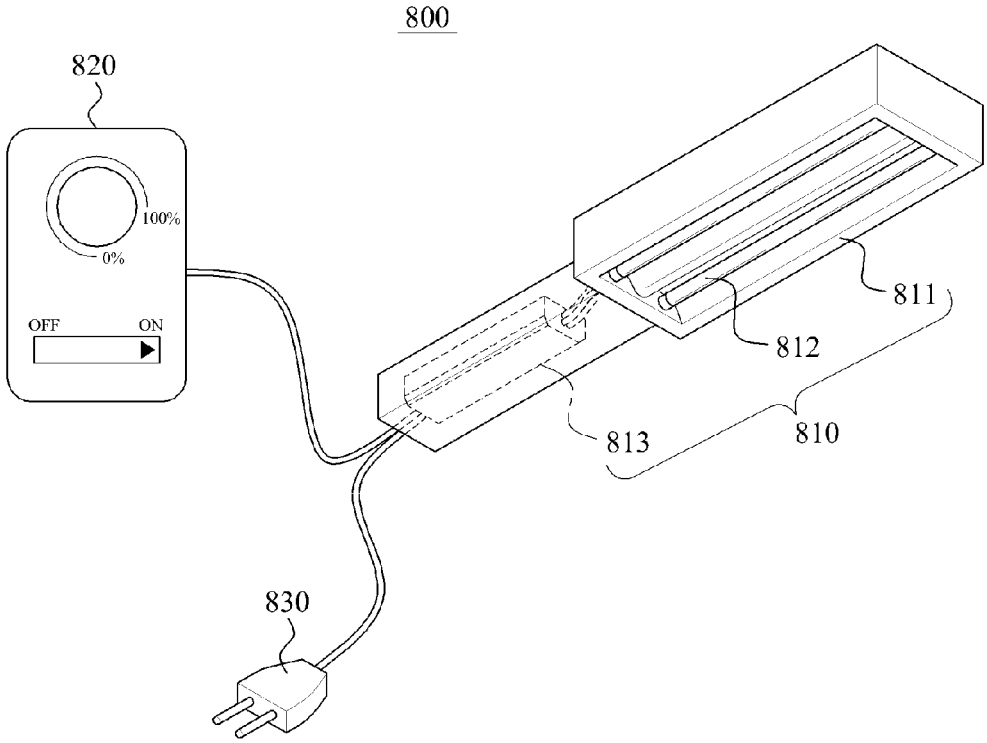
FIGS. 14 through 16 are diagrams respectively illustrating various lighting apparatuses employing PSUs manufactured by a PSU manufacturing method according to various embodiments of the present invention.
Figure 15:
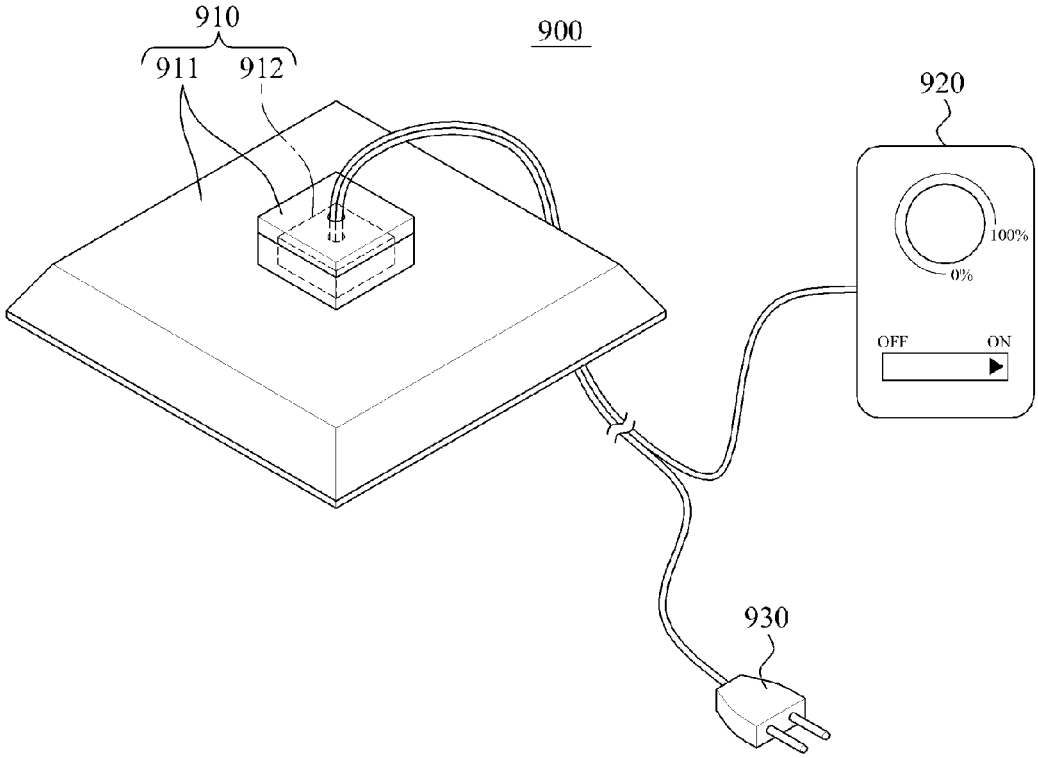
Figure 16:
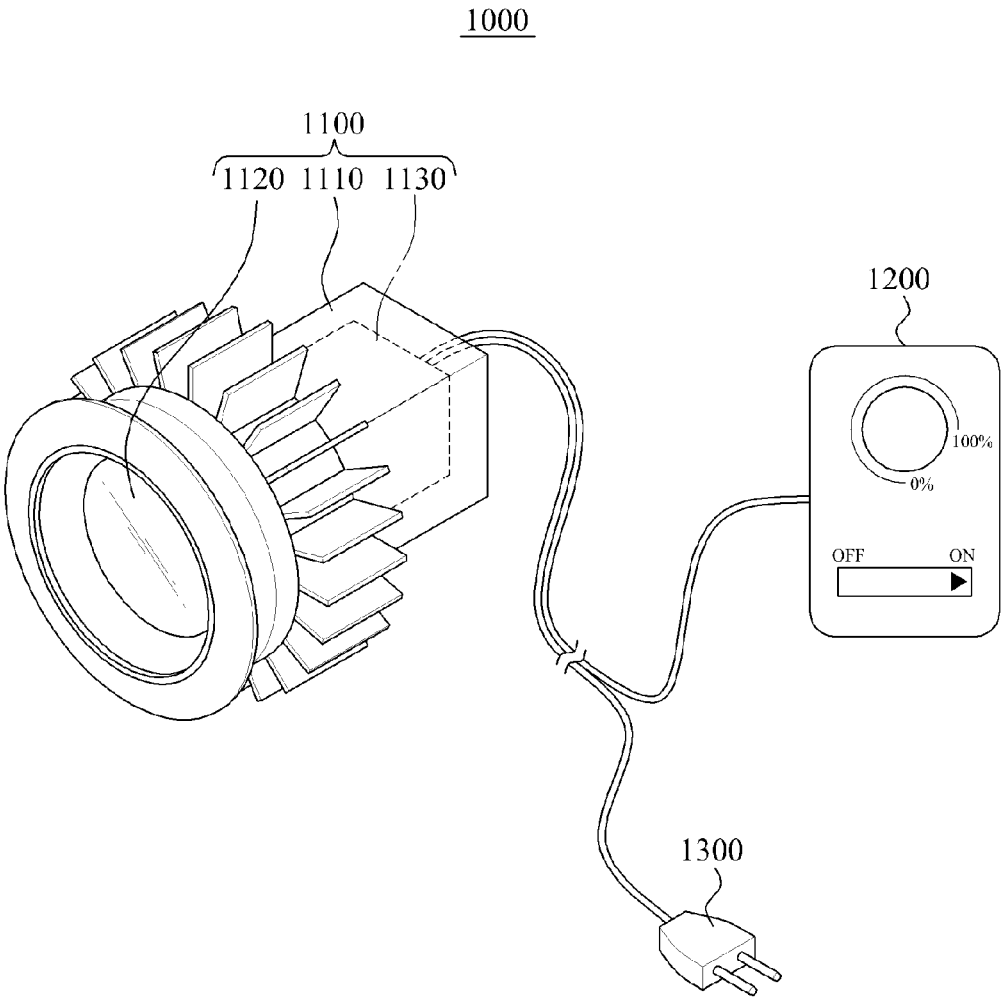

FIGS. 14 through 16 are diagrams respectively illustrating lighting apparatuses 800, 900, and 1000 employing PSUs manufactured using a PSU manufacturing method according to various embodiments of the present invention.

The lighting apparatuses 800, 900, and 1000 may employ PSUs 813, 912, and 1130, respectively. The PSUs 813, 912, and 1130 may be manufactured using one of the system 100 of FIG. 1, the flicker measurement apparatus 140 of FIG. 4, the method of FIG. 9, and the second test methods of FIGS. 12 and 13. The PSUs 813, 912, and 1130 may be determined to be in the normal state through a first test for electrical characteristics, and a second test including flicker measurement.

Referring to FIG. 14, the lighting apparatus 800 may be used as an L-tube lighting, and may include a lighting unit 810, a dimmer 820, and a power source unit 830.

The lighting unit 810 may include a main body 811, a light source 812 for lighting, and the PSU 813.

The main body 811 may have space in which the light source 812 is to be mounted, and space in which the PSU 813 is to be mounted. The light source 812 may include, for example, an LED, a fluorescent lamp, a lamp, and the like. Referring to FIG. 14, the light source 812 and the PSU 813 may be mounted in the space in the main body 811. The light source 812 may be connected to the PSU 813, and may receive a power source from the PSU 813, and brightness of the light source 812 may be adjusted by the dimmer 820.

Since the PSU 813 is determined to be in the normal state based on the flicker measurement result, the light source 812 may be normally emit light by receiving the power source from the PSU 813. Additionally, since the PSU 813 is normally operated despite the power source being adjusted, the dimmer 820 may accurately adjust the brightness of the light source 812.

Referring to FIG. 15, the lighting apparatus 900 may be used as a flat lighting apparatus, and may include a lighting unit 910, a dimmer 920, and a power source unit 930.

The lighting unit 910 may include a main body 911, a light source for lighting (not shown), and the PSU 912.

The main body 911 may have space in which the light source is to be mounted, and space in which the PSU 912 is to be mounted. The light source may include, for example, an LED, a fluorescent lamp, a lamp, and the like.

The light source may be connected to the PSU 912, and may receive a power source from the PSU 912, and brightness of the light source may be adjusted by the dimmer 920.

Since the PSU 912 is determined to be in the normal state based on the flicker measurement result, the light source may be normally emit light by receiving the power source from the PSU 912. Additionally, since the PSU 912 is normally operated despite the power source being adjusted, the dimmer 920 may accurately adjust the brightness of the light source.

Referring to FIG. 16, the lighting apparatus 1000 may be used as a down lighting apparatus to direct light downward. The lighting apparatus 1000 may include a lighting unit 1100, a dimmer 1200, and a power source unit 1300.

The lighting unit 1100 may include a main body 1110, a light source 1120 for lighting, and the PSU 1130.

The main body 1100 may have space in which the light source 1120 is to be mounted, and space in which the PSU 1130 is to be mounted. The light source 1120 may include, for example, an LED, a fluorescent lamp, a lamp, and the like.

The light source 1120 may be connected to the PSU 1130, and may receive a power source from the PSU 1130, and brightness of the light source 1120 may be adjusted by the dimmer 1200.

Since the PSU 1130 is determined to be in the normal state based on the flicker measurement result, the light source 1120 may be normally emit light by receiving the power source from the PSU 1130.

The lighting apparatuses 800, 900, and 1000 may be used for battlefield use, as well as, for industrial use and for home use.

The PSUs 813, 912, and 1130 are applied to the lighting apparatuses 800, 900, and 1000, as shown in FIGS. 14 through 16, but there is no limitation thereto. Accordingly, the PSUs 813, 912, and 1130 may also be applied to various lighting apparatuses, for example a ceiling light, a spot light, and the like.

Additionally, the PSUs 813, 912, and 1130 may be employed by a display means such as a display apparatus, instead of the lighting apparatuses 800, 900, and 1000.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A flicker measurement apparatus of a power supply unit (PSU), the flicker measurement apparatus comprising:

a light detecting module to detect a light emitted from at least one light source;

a signal input/output module to input and output a signal, the signal input/output module being connected to at least one PSU supplying a dimming signal to the at least one light source;

a signal processing module to convert the detected light into an electrical signal, and to process the electrical signal; and a control module to control the at least one PSU based on a dimming control signal, to measure a flicker of the at least one light source using the processed electrical signal, and to determine a state of the at least one PSU based on a flicker measurement result obtained by measuring the flicker.

2. The flicker measurement apparatus of claim 1, wherein the dimming control signal comprises channel information associated with the at least one PSU, a dimming signal range in which the dimming signal is to be supplied to the at least one light source, a dimming signal interval to be adjusted within the dimming signal range, and a period in which the dimming signal is to be supplied and which corresponds to the dimming signal interval.

3. The flicker measurement apparatus of claim 1, wherein the signal processing module comprises:

a signal converter to convert the detected light into the electrical signal;

a low band pass filter to enable a low-frequency signal to pass, the low-frequency signal being included in the electrical signal;

an analog-to-digital converter (ADC) to convert the low-frequency signal into a digital signal; and a fast Fourier transform (FFT) unit to generate a frequency signal by performing FFT on the digital signal, the frequency signal comprising an alternating current (AC) component and a direct current (DC) component.

4. The flicker measurement apparatus of claim 3, wherein the control module comprises:

an input unit to receive an input of information required to generate the dimming control signal;

a signal receiver to receive the frequency signal from the signal processing module;

a signal transmitter to transmit the dimming control signal to the at least one PSU;

a first controller to generate the dimming control signal based on the received information; and a second controller to separate the AC component and the DC component from the frequency signal, to compute a ratio of the AC component to the DC component, and to measure the flicker.

5. The flicker measurement apparatus of claim 4, wherein, when the computed ratio is less than a predetermined threshold, the second controller determines the at least one PSU to be in a normal state, and wherein, when the computed ratio is equal to or greater than the predetermined threshold, the second controller determines the at least one PSU to be in an abnormal state.

6. The flicker measurement apparatus of claim 5, wherein the second controller generates result data by matching the dimming control signal, the frequency signal, the flicker measurement result, and a result of determining the state of the at least one PSU, and stores the generated result data in a storage medium.

7. The flicker measurement apparatus of claim 6, wherein, when a command to read the result data is received from the input unit, the second controller reads result data corresponding to the command from the storage medium, and displays the read result data on a screen.

8. The flicker measurement apparatus of claim 1, wherein the control module transfers, to the at least one PSU, an aging signal including an aging condition and an aging time, and controls an aging test to be performed on the at least one PSU in the aging condition during the aging time.

9. A lighting apparatus employing a PSU determined to be in the normal state among the at least one PSU, based on the flicker measured by the flicker measurement apparatus of claim 1.

10. A method of manufacturing a power supply unit (PSU), the method comprising:

controlling at least one PSU based on a dimming control signal, the at least one PSU supplying a dimming signal to at least one light source;

detecting a light emitted from the at least one light source;

converting the detected light into an electrical signal, and processing the electrical signal;

measuring a flicker of the at least one light source using the processed electrical signal; and determining a state of the at least one PSU based on a flicker measurement result obtained by measuring the flicker.

11. The method of claim 10, wherein the dimming control signal comprises channel information associated with the at least one PSU, a dimming signal range in which the dimming signal is to be supplied to the at least one light source, a dimming signal interval to be adjusted within the dimming signal range, and a period in which the dimming signal is to be supplied and which corresponds to the dimming signal interval.

12. The method of claim 11, wherein the controlling comprises adjusting the dimming signal interval within the dimming signal range for the period, based on the dimming control signal, and supplying the dimming signal to the at least one light source.

13. The method of claim 10, wherein the converting comprises:

converting the detected light into the electrical signal;

enabling a low-frequency signal to pass, the low-frequency signal being included in the electrical signal;

converting the low-frequency signal into a digital signal; and generating a frequency signal by performing fast Fourier transform (FFT) on the digital signal, the frequency signal comprising an alternating current (AC) component and a direct current (DC) component.

14. The method of claim 13, wherein the measuring comprises:

separating the AC component and the DC component from the frequency signal; and computing a ratio of the AC component to the DC component, and measuring the flicker.

15. The method of claim 14, wherein the determining comprises:

determining the at least one PSU to be in a normal state, when the computed ratio is less than a predetermined threshold;

determining the at least one PSU to be in an abnormal state, when the computed ratio is equal to or greater than the predetermined threshold.

16. The method of claim 14, further comprising:

generating result data by matching the dimming control signal, the frequency signal, the flicker measurement result, and a result of determining the state of the at least one PSU; and storing the generated result data in a storage medium.

17. A lighting apparatus employing the at least one PSU manufactured by the method of claim 10.

18. A control module, comprising:

an input unit to receive an input of information required to generate a dimming control signal, the dimming control signal being used to control an operation of at least one power supply unit (PSU);

a signal transmitter to transmit the dimming control signal to the at least one PSU;

a signal receiver to receive a frequency signal corresponding to a light detected from at least one light source;

a first controller to generate the dimming control signal based on the received information; and a second controller to measure a flicker of the at least one light source using the received frequency signal, and to test the at least one PSU based on a flicker measurement result obtained by measuring the flicker.

19. The control module of claim 18, wherein the second controller separates an alternating current (AC) component and a direct current (DC) component that are included in the frequency signal, computes a ratio of the AC component to the DC component, and measures the flicker.

20. The control module of claim 19, wherein, when the computed ratio is less than a predetermined threshold, the second controller determines the at least one PSU to be in a normal state, and wherein, when the computed ratio is equal to or greater than the predetermined threshold, the second controller determines the at least one PSU to be in an abnormal state.

* * * * *